US005873343A

United States Patent [19]

Denton

[11] Patent Number: 5,873,343

[45] Date of Patent: Feb. 23, 1999

[54] DIESEL ENGINE EMERGENCY SHUTOFF DEVICE AND METHOD

[76] Inventor: Daniel Webster Denton, P.O. Box 87, Boling, Tex. 77420

[21] Appl. No.: 732,935

[22] Filed: Oct. 17, 1996

[51] Int. Cl.[6] ..... F02D 9/08

[52] U.S. Cl. ..... 123/198 D

[58] Field of Search ..... 123/184.21, 198 D; 251/337

[56] References Cited

U.S. PATENT DOCUMENTS

| | | | |
|---|---|---|---|
| 4,129,040 | 12/1978 | Hayden, Jr. | 123/198 D |
| 4,422,418 | 12/1983 | Dorn | 123/198 D |
| 4,485,781 | 12/1984 | Barnes | 123/198 D |
| 4,499,733 | 2/1985 | Farr et al. | 123/198 D |
| 4,651,683 | 3/1987 | Nishida | 123/198 D |
| 5,003,943 | 4/1991 | Lafferty, Sr. | 123/198 D |
| 5,038,808 | 8/1991 | Stumpp | 123/198 D |
| 5,050,548 | 9/1991 | Minegishi | 123/198 D |
| 5,056,482 | 10/1991 | Chonan et al. | 123/198 D |
| 5,205,252 | 4/1993 | Krepela | 123/198 D |

*Primary Examiner*—David A. Okonsky
*Attorney, Agent, or Firm*—Michael B. Jolly

[57] ABSTRACT

An improvement for diesel engine emergency shutoff devices and method for intake air-flow shutoff valves. The device includes tubing connecting the engine's exhaust manifold with the intake manifold at a location down stream from the shutoff valve with a check valve which prevents exhaust gas from entering the intake manifold until vacuum within the intake manifold reaches a desired level. When the emergency shutoff device operates, intake manifold vacuum opens the check valve and allows oxygen deficient exhaust gas to enter the intake manifold preventing a sudden damaging vacuum while also allowing the shutoff device to completely shutdown the engine.

13 Claims, 3 Drawing Sheets

DIESEL ENGINE EMERGENCY SHUTOFF DEVICE AND METHOD

BACKGROUND OF THE INVENTION

It is well known that diesel engines pose particular problems when operating in an atmosphere or environment containing natural gas or other volatile hydrocarbons. This often occurs in oil fields or chemical plants where engines, operating in and around a volatile fuel source, draw feral gas into the engine's intake manifold resulting in uncontrollable engine revving and possible catastrophic engine failure.

Numerous devices have been developed which block air induction into the air intake of an overrevving diesel engine including; RIGSAVER$_{TM}$, AMONT$_{TM}$, CHALMATIC$_{TM}$, and GATOR$_{TM}$. These devices when actuated rapidly shutdown all or most of the engine's intake air with a valve member thereby starving the engine of oxygen required for internal combustion resulting in almost immediate engine cessation. While the devices provide an effective shutdown system the means by which the shutdown devices block engine intake air at a moment when the engine is operating at high RPMs leads to a considerable low and immediate evacuation of the engine's air intake system downstream from the shutdown device. The evacuation though necessary to rapidly shut down the engine leads to sometimes devastating effects upon the engine's turbocharger seals and thrust washers. After an emergency shutdown the turbocharger is sometimes incapacitated until the damaged parts can be replaced. Therefore, a need exist to shutdown a diesel engine by blocking the engine's air intake while not damaging the turbocharger or other related parts. The present invention provides a means for not only shutting down the diesel engine by blocking the air intake but also doing so without damaging these parts.

The invention utilizes a tubing connection between the engine's exhaust manifold and the engine's intake manifold downstream from the shutdown device. The tubing connection includes a check valve to prevent the flow of exhaust gases into the intake manifold until the vacuum level in the intake manifold reaches a desired level. When the shutdown device blocks intake air and a vacuum develops in the intake tubing between the shutdown device and the engine, exhaust gases will enter the evacuated intake manifold preventing a damaging vacuum from forming while also not introducing any oxygen into the engine's intake manifold thereby allowing the engine to be shutdown. After the vacuum is depleted the check valve returns to the closed position blocking the flow of exhaust gases into the intake manifold.

SUMMARY OF THE INVENTION

It is accordingly an object of the present invention to provide an improved diesel engine emergency shutoff device which is utilized with an existing air induction shutdown device and further prevents engine component part damage associated with the use of air induction shutdown devices.

It is a further object of the invention to provide an improvement for air induction diesel engine emergency shutdown devices which prevents damage to turbocharger component parts caused by the sudden low vacuum in the engine intake manifold created by operation of air induction shutdown devices.

It is another object of the present invention to provide an apparatus which diverts exhaust gases into the intake manifold of a diesel engine when the engine's air intake manifold reaches a desired vacuum level thereby preventing the vacuum in the intake manifold from reaching a level which damages turbocharger seals and thrust washers, and further providing a means for preventing exhaust gases from entering the intake manifold during normal engine operation.

It is another object of the present invention to provide a process for preventing damage to turbocharger seals when a diesel engine air induction shutdown device operates to shutdown an overrevving diesel engine, the process comprising a means for delivering exhaust gases into the engine's intake manifold downstream from the shutdown device when a vacuum develops in the engine's intake manifold as a consequence of the shutdown device's operation.

It is another object of the present invention to provide a process for improving diesel engine shutdown devices which operate by blocking engine air induction when the engine experiences overrevving, the improvement comprising adding exhaust gases to the engine's intake manifold downstream from the shutdown device before the vacuum in the intake manifold reaches a level which will damage turbocharger seals.

It is another object of the present invention to provide a process for shutting down a diesel engine wherein said diesel engine is equipped with an air induction shutdown device and further said engine being equipped with an exhaust manifold and an intake manifold wherein the process includes introducing a volume of exhaust gases into the intake manifold when the shutdown device blocks the flow of air into the engine's intake manifold said volume of exhaust gases being sufficient to deplete the vacuum created in the intake manifold and further to prevent damage to the turbocharger seals and thrust washer and related parts.

It is another object of the present invention to provide an improvement for diesel engine shutdown devices which operate by blocking engine air induction when the engine experiences overrevving, the improvement comprising an equalizing tube connected to the engines exhaust manifold and the engine's intake manifold at a point downstream from the shutdown device, a means for preventing the flow of exhaust gases from the exhaust manifold to the intake manifold under normal engine operation and a means for allowing the flow of exhaust gases to the intake manifold when the shutdown device operates to shutdown an overrevving engine, the means for allowing the flow of exhaust gases into the intake manifold further only opening when the vacuum level in the intake manifold reaches a set value.

DETAILED DESCRIPTION OF THE DRAWINGS

Figure 1:
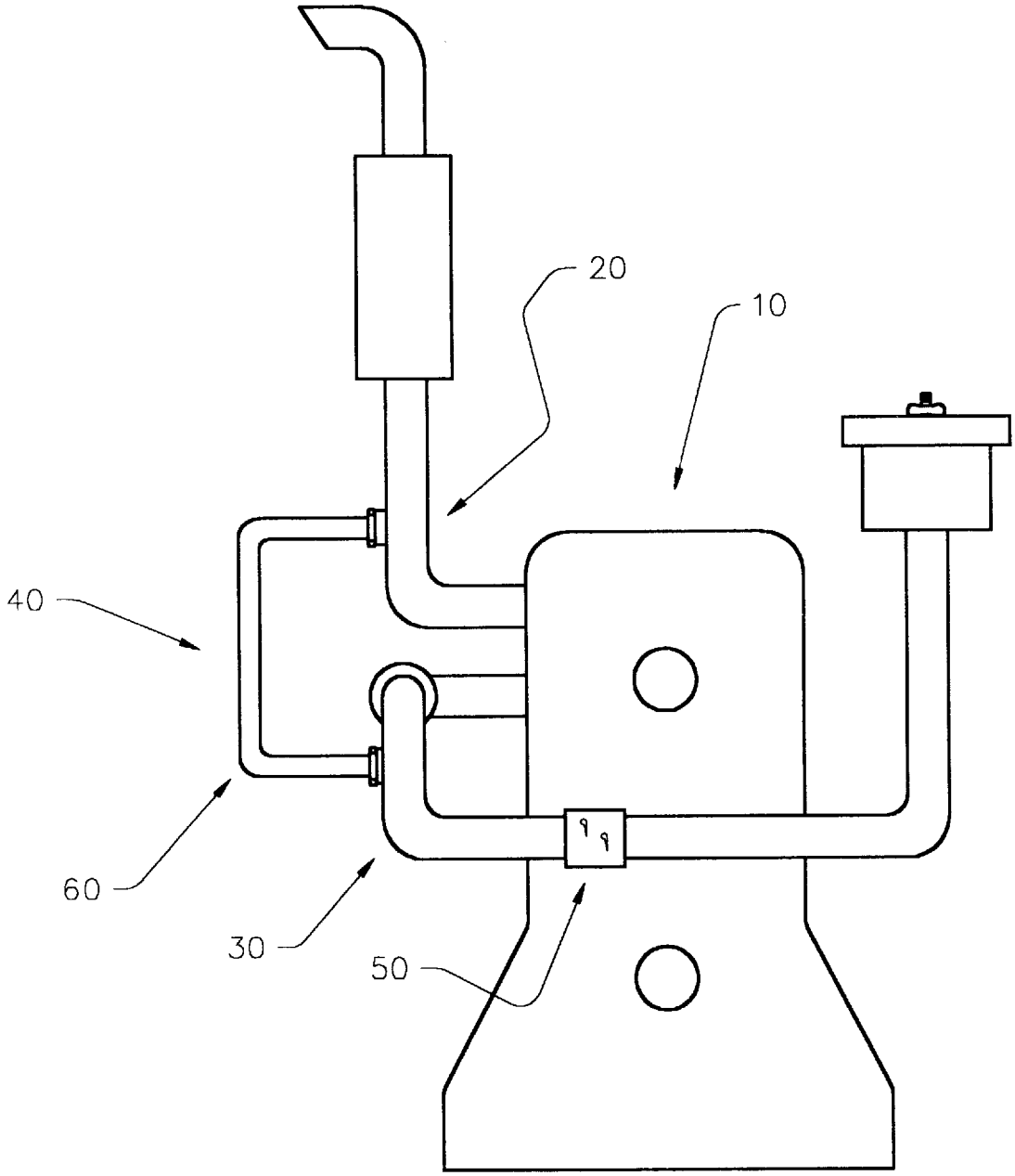
FIG. 1 is a front view of a diesel engine illustrating the improvement installed upon an engine equipped with a turbocharger.

Referring to the drawings the improvement for the diesel engine air induction shutoff device according to the invention is illustrated as installed upon a diesel engine 10 generally at FIG. 1. The improvement is essentially a pressure equalizing tube 40 which connects the engine's exhaust manifold 20 with the engine's intake manifold 30. The connection point for the equalling tube 40 at the intake manifold 30 is down stream (between the shutoff device and the engine) from the shutoff device 50. The equalizing tube 40 further includes a check valve 60 or some other means for selectively releasing the flow of exhaust gases from the exhaust manifold 20 into the intake manifold 30 through the equalizing tube 40.

The equalizing tube 40 operates to prevent a sudden damaging vacuum from forming in the intake manifold 20 between the shutdown device 50 and the engine 10 when the shutdown device 50 operates to shutdown air induction on an overrevving engine while also allowing the shutdown device 50 to operate as intended. An extremely low vacuum is created when air induction shutdown devices operate and further the vacuum has damaging effects upon turbocharger seals and thrust washers. Additionally, it has been found that replacement of these seals is necessary prior to restarting the engine. Diesel engine and turbocharger manufacturers have expressed a desire to prevent the damage caused by the air induction shutdown devices, and further have expressed concerns about using air induction shutdown devices. The present invention provides a means for allowing the air induction shutdown devices to operate effectively and also preventing the damaging effects of pulling a vacuum on a turbocharger. The improvement operates by adding exhaust gases to the evacuated intake manifold only when the shutdown device is in operation and since exhaust gases are oxygen deficient, the added gases which deplete the vacuum do not contribute to engine combustion, so the shutdown device is allowed to perform its intended function.

The tubing used for making the connection between the exhaust manifold and the intake manifold is most preferable a noncorrosive material and further dimensioned to supply sufficient exhaust gas to the evacuated intake manifold and deplete the vacuum to a point where no damaging effects occur to the turbocharger component parts. The tubing is most preferable about ¾ to about 1 ½ inches in diameter, the dimension depending upon the engine si conventional means including welding the tubing directly on the exhaust manifold or welding a fitting on the manifold for connection of the tubing. The tubing connection upon the intake manifold is carried out in a like manner.

Figure 2:
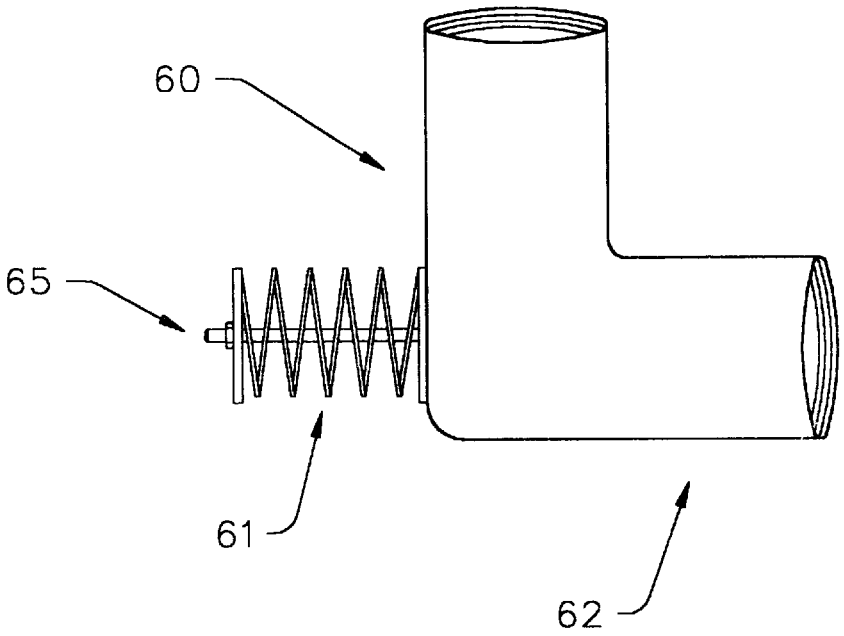
FIG. 2 is a plain view of a check valve.
Figure 3:
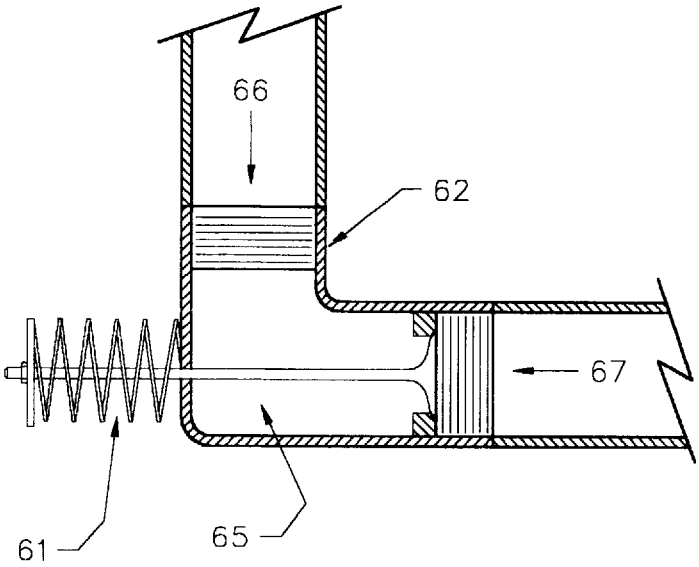
FIG. 3 is a cross sectional view of the check valve.

The apparatus includes a means for preventing the flow of exhaust gases into the intake manifold under normal engine operating conditions. The invention most preferable utilizes a check valve 60 with an adjustable valve tension means 61. FIGS. 2 and 3 illustrate a check valve, known to the art, suitable for accomplishing this task. Most preferable the valve adjustable valve tension means 61 is composed of noncorrosive material such as stainless steel, and further said adjustment means being isolated from contact with exhaust gases and direct exhaust gas heat. The disclosed valve illustrates the preferred adjustment means positioned outside the valve body. Tension spring 61 and valve member 65 are positioned so that the valve closes when air flows from the intake manifold 67 to the exhaust manifold 66. Conversely, the valve will open if sufficient air pressure flows from the exhaust manifold direction 66 to the intake manifold 67, or if sufficient vacuum exist in the intake manifold. The valve body most preferable will be about ¾ to about 1 ½ inches in diameter depending upon the engine's size.

I claim:

1. An improvement for diesel engine air induction shutdown devices wherein the diesel engine is equipped with an exhaust manifold and an air intake manifold wherein the shutdown device is equipped with a valve member which blocks the flow of air into the air intake manifold when the engine overrevs, the improvement comprising:

a) a means including a tube for delivering exhaust gases from the exhaust manifold to the intake manifold at a point on the intake manifold between the shutdown device and the engine, b) a means for preventing the flow of exhaust gas from the exhaust manifold to the intake manifold through the tube until a desired vacuum level exist in the intake manifold.

2. The apparatus as set forth in claim 1 wherein said means for delivering exhaust gases from the exhaust manifold to the intake manifold comprises an aperture between the exhaust manifold and the intake manifold.

3. The apparatus as set forth in claim 1 wherein said means for preventing the flow of exhaust gases into the intake manifold further comprises a check valve which valve is closed under normal engine operating conditions and pressures and which opens allowing exhaust gases to enter the intake manifold when the shutdown device operates blocking the engine's air induction.

4. The apparatus as set forth in claim 1 wherein said means for preventing the flow of exhaust gases into the intake manifold further comprises a one way valve which allows the flow of exhaust gases into the intake manifold when the shutdown device operates blocking the engine's air induction.

5. The apparatus as set forth in claim 1 wherein said means for preventing the flow of exhaust gases into the intake manifold further comprises a check valve, said check valve further comprising;

a) a cylindrical valve body forming a valve cavity, b) a valve seat disposed within said valve body cavity, c) a valve member with a valve stem extending from said valve member said valve member being disposed within said valve body with said valve stem extending from said valve cavity and further said valve member sealingly contacting said valve seat, d) a valve spring disposed upon said valve stem and further positioned outside said valve cavity, and e) a valve spring tension adjustment means positioned upon said valve stem.

6. An improvement for diesel engine air induction shutdown devices wherein the diesel engine is equipped with an exhaust manifold and an air intake manifold wherein the shutdown device is equipped with a valve member which blocks the flow of air into the air intake manifold when the engine overrevs, the improvement comprising:

a) tubing connected between the exhaust manifold and the intake manifold which delivers exhaust gases from the exhaust manifold to the intake manifold, b) a check valve positioned within said tubing for preventing the flow of exhaust gases into the intake manifold, said check valve further comprising; a cylindrical valve body forming a valve cavity, a valve seat disposed within said valve body cavity, a valve member with a valve stem extending from said valve member, said valve member being disposed within said valve body with said valve stem extending from said valve cavity and further said valve member sealingly contacting said valve seat, a valve spring disposed upon said valve stem and further positioned outside said valve cavity, and e) a valve spring tension adjustment means positioned upon said valve stem.

7. Apparatus as set forth in claim 6 wherein said tubing further comprises tubing between about ¾ to about 1 ½ inches internal diameter.

8. Apparatus as set forth in claim 6 wherein said valve body further comprises a cylindrical valve body between about ¾ to about 1 ½ inches internal diameter.

9. Apparatus as set forth in claim 6 wherein said tubing and said valve elements further comprise tubing and valve elements constructed of corrosion resistant and heat resistant material.

10. Apparatus as set forth in claim 6 wherein said tubing and said valve elements further comprise tubing and valve elements constructed of stainless steel.

11. An improvement for diesel engine air induction shutdown devices wherein the diesel engine is equipped with an exhaust manifold and an air intake manifold and wherein the shutdown device is equipped with a valve member which selectively blocks the flow of air into the air intake manifold when the engine overrevs, the improvement comprising:

a) a means for providing a process wherein exhaust gases are introduced into the engine's intake manifold, said exhaust gas being introduced at a location on the intake manifold between the shutdown device and the engine, further said exhaust gases being introduced only when the shutdown device is in operation.

12. A process for shutting down an overrevving diesel engine wherein the diesel engine is equipped with air induction shutdown device and further wherein the diesel engine is equipped with an exhaust manifold and an air intake manifold and wherein the shutdown device is equipped with a valve member which blocks the flow of air into the air intake manifold when the engine overrevs, the process comprising the steps;

a) introducing a portion of the engine's exhaust gases into the intake manifold when the shutdown device blocks the flow of air into the intake manifold, a) blocking the flow of the engine's exhaust gases into the intake manifold when the engine is operating under normal conditions.

13. The process as set forth in claim 12 wherein step (a) further comprises introducing a volume of exhaust gases into the intake manifold which volume is sufficient to deplete the vacuum formed in the intake manifold by the shutdown device's operation to a point that the vacuum in the intake manifold will not damage the seals of a turbocharger.

* * * * *